US005526243A

United States Patent [19]

Masters

[11] Patent Number: 5,526,243

[45] Date of Patent: Jun. 11, 1996

[54] ADJUSTABLE LOW VOLTAGE DECORATIVE LIGHT ENCLOSURE

[76] Inventor: Jack W. Masters, 1 Stevens La., Voorhees, N.J. 08043

[21] Appl. No.: 383,454

[22] Filed: Feb. 3, 1995

[51] Int. Cl.[6] ..... F21P 1/02

[52] U.S. Cl. ..... 362/122; 362/431; 362/449; 362/806

[58] Field of Search ..... 362/122, 152, 362/277, 431, 449, 806

[56] References Cited

U.S. PATENT DOCUMENTS

| | | | |
|---|---|---|---|
| D. 318,136 | 7/1991 | Kira | D26/68 |
| D. 333,189 | 2/1993 | Hall et al. | D26/67 |
| D. 345,435 | 3/1994 | McLaughlin | D26/125 |
| D. 345,621 | 3/1994 | McLaughlin | D26/127 |
| D. 349,359 | 8/1994 | McLaughlin | D26/101 |
| 3,281,589 | 10/1966 | Cronan | 362/449 |
| 4,523,263 | 6/1985 | Poyer | 362/267 |
| 4,870,548 | 9/1989 | Beachy et al. | 362/277 |
| 5,274,537 | 12/1993 | Altman | 362/152 |
| 5,280,417 | 1/1994 | Hall et al. | 362/226 |
| 5,297,013 | 3/1994 | Hall et al. | 362/363 |
| 5,412,554 | 5/1995 | Lee | 362/449 |

*Primary Examiner*—Denise L. Gromada
*Assistant Examiner*—Sara S. Raab
*Attorney, Agent, or Firm*—Norman E. Lehrer; Jeffrey S. Ginsberg

[57] ABSTRACT

A decorative enclosure or cover is adjustably fitted over a low voltage light fixture. The light fixture is of the type that has a stake adapted to be partially inserted into the ground, a support extending upwardly from the stake, a light bulb assembly mounted atop the support, a light cover positioned over the light bulb assembly and a power source connected to the bulb assembly for supplying electricity to the same. The light cover includes a sleeve that extends downwardly from the bottom thereof. The sleeve is slidable along the support and has at least one opening formed therethrough. A screw is threaded through the opening in the sleeve wall in order to engage the support and maintain the enclosure in place.

16 Claims, 3 Drawing Sheets

ADJUSTABLE LOW VOLTAGE DECORATIVE LIGHT ENCLOSURE

BACKGROUND OF THE INVENTION

The present invention is directed to a low voltage light enclosure and, more particularly, to a decorative enclosure that is adjustably mounted to a light fixture.

Outdoor light fixtures are well known in the art. Such fixtures are used to illuminate gardens, walkways, driveways, patios and other areas. Typically, low voltage outdoor light fixtures have a stake that is adapted to be inserted into the ground, a support means extending upwardly from the stake, a light bulb mounted atop the support means, a power source for supplying electricity to the light bulb and a globe fitted over the light bulb. The power source typically supplies 12 volts through wires that run underground from the power source to the light fixture. See, for example, U.S. Pat. Nos. 5,280,417 and 5,297,013.

The light enclosures or covers serve a number of purposes. For example, they protect the bulbs from damage and also diffuse the light emitted from the same. Additionally, the light covers can provide the light fixtures with a decorative appearance.

Typically, a series of light fixtures, which are arranged in some sort of pattern, are utilized at the same time. It is desirable for the tops of adjacent light covers to be level in order to provide an orderly and aesthetically pleasing appearance. However, if one or more of the light fixtures are mounted in uneven terrain, the tops of adjacent light covers will not be level since existing covers are not adjustably mounted to their respective light fixtures. Therefore, the light covers cannot be moved closer to or further from the ground in order compensate for the uneven terrain.

Furthermore, conventional light enclosures are generally of standard ordinary appearance. On holidays, birthdays, anniversaries and other occasions, however, it may be desirable to decorate a home or garden by utilizing decorative light covers or enclosures with pre-existing low voltage lighting. Such covers in the form of a snowman, a pumpkin and a Christmas tree are shown, for example, in U.S. Pat. Nos. 345,435, 345,621 and 349,359. These prior art enclosures, however, are not securely attached to the light fixture. Rather, they are simply placed over the light bulb and are either supported by the bulb or rest on the ground. Accordingly, these light covers may be uneven and are susceptible to theft or to other undesirable removal from the light fixture.

SUMMARY OF THE INVENTION

The present invention is designed to overcome the deficiencies of the prior art discussed above. It is an object of the invention to provide a decorative enclosure or cover that is adjustably secured to a low voltage light fixture.

It is a further object to provide such a light cover that is securely attached to the light fixture.

In accordance with the illustrative embodiments, demonstrating features and advantages of the present invention, there is provided a light fixture of the type that includes a support means, a light bulb assembly mounted atop the support means, a light cover positioned over the light bulb assembly and a power supply means connected through the support means to the bulb assembly for supplying electricity to the bulb assembly. The light cover has a sleeve that extends downwardly from the bottom thereof. The sleeve is slidable along the support means and has an opening formed therethrough and a screw adapted to be threaded through the opening in order to secure the light cover in place. The cover can have substantially any decorative appearance.

Other objects, features and advantages of the invention will be readily apparent from the following detailed description of a preferred embodiment thereof taken in conjunction with the drawings.

BRIEF DESCRIPTION OF THE DRAWINGS

For the purpose of illustrating the invention, there are shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
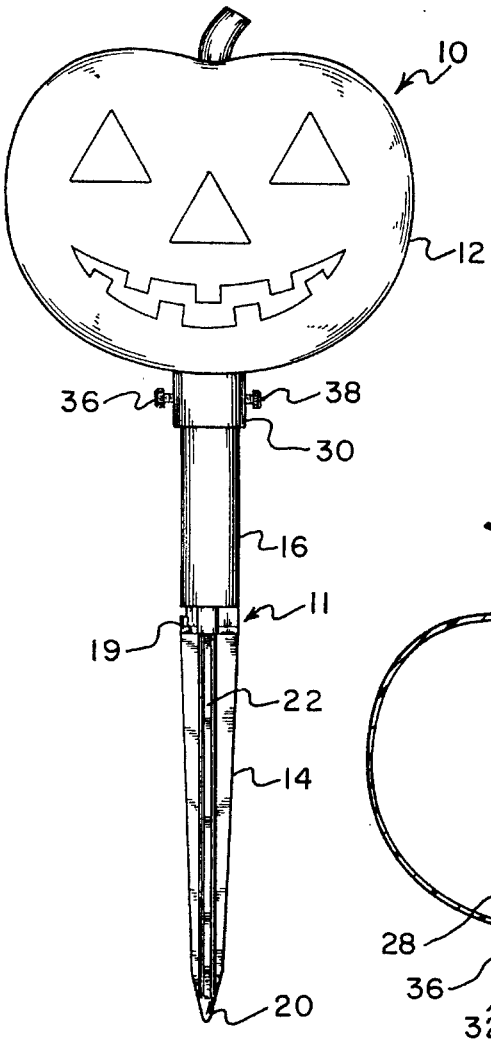
FIG. 1 is a front elevational view of a light cover and fixture constructed in accordance with the principles of the invention.

Referring now to the drawings in detail wherein like reference numerals have been used throughout the various figures to designate like elements, there is shown in FIG. 1 an adjustable decorative low voltage light cover fixture constructed in accordance with the principles of the present invention and designated generally as 10.

The low voltage light cover 10 is adapted to fit over the upper portion of a light fixture 11 which is, per se, well known in the art. More specifically, the light fixture 11 includes a stake 14, a support 16 that extends upwardly from the stake 14 and a light bulb assembly 18 secured atop the support 16 (see FIGS. 3, 4 and 7). Electric current from a 12 volt source is supplied by wires (not shown) to the bulb assembly 18 in order to illuminate the same.

Figure 3:
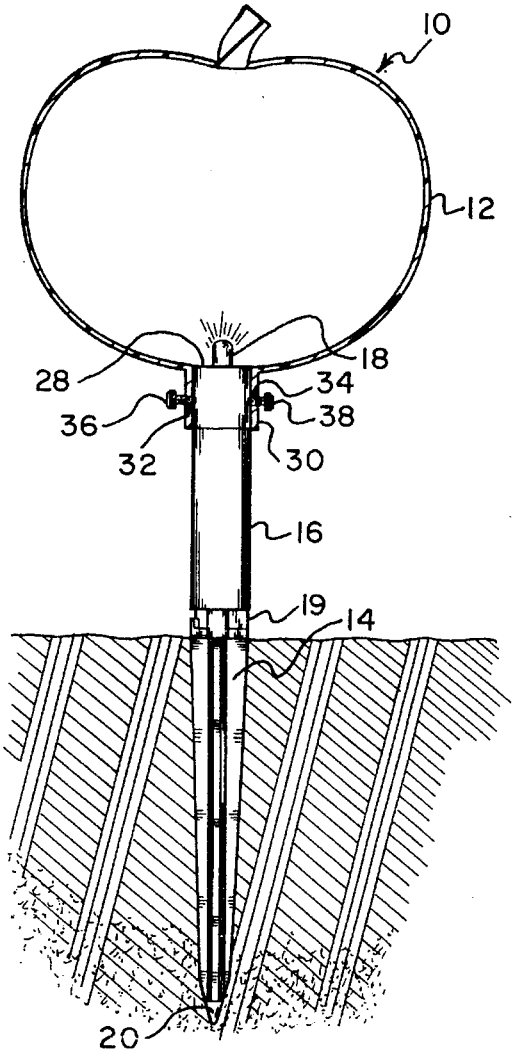
FIG. 3 is a partial cross sectional front view of FIG. 1 shown secured in the ground.

The stake has a top end 19 and a pointed bottom end 20. The pointed bottom end 20 is adapted to be inserted into the ground as shown in FIG. 3. Accordingly, part of the stake is positioned underground in order to anchor the same in a desired position. The stake is preferably comprised of a material that resists decay and corrosion such as plastic. The stake has a channel 22 extending from the top end 19 to the bottom end 20 which can serve as a guide for the wires (not shown).

Figure 7:
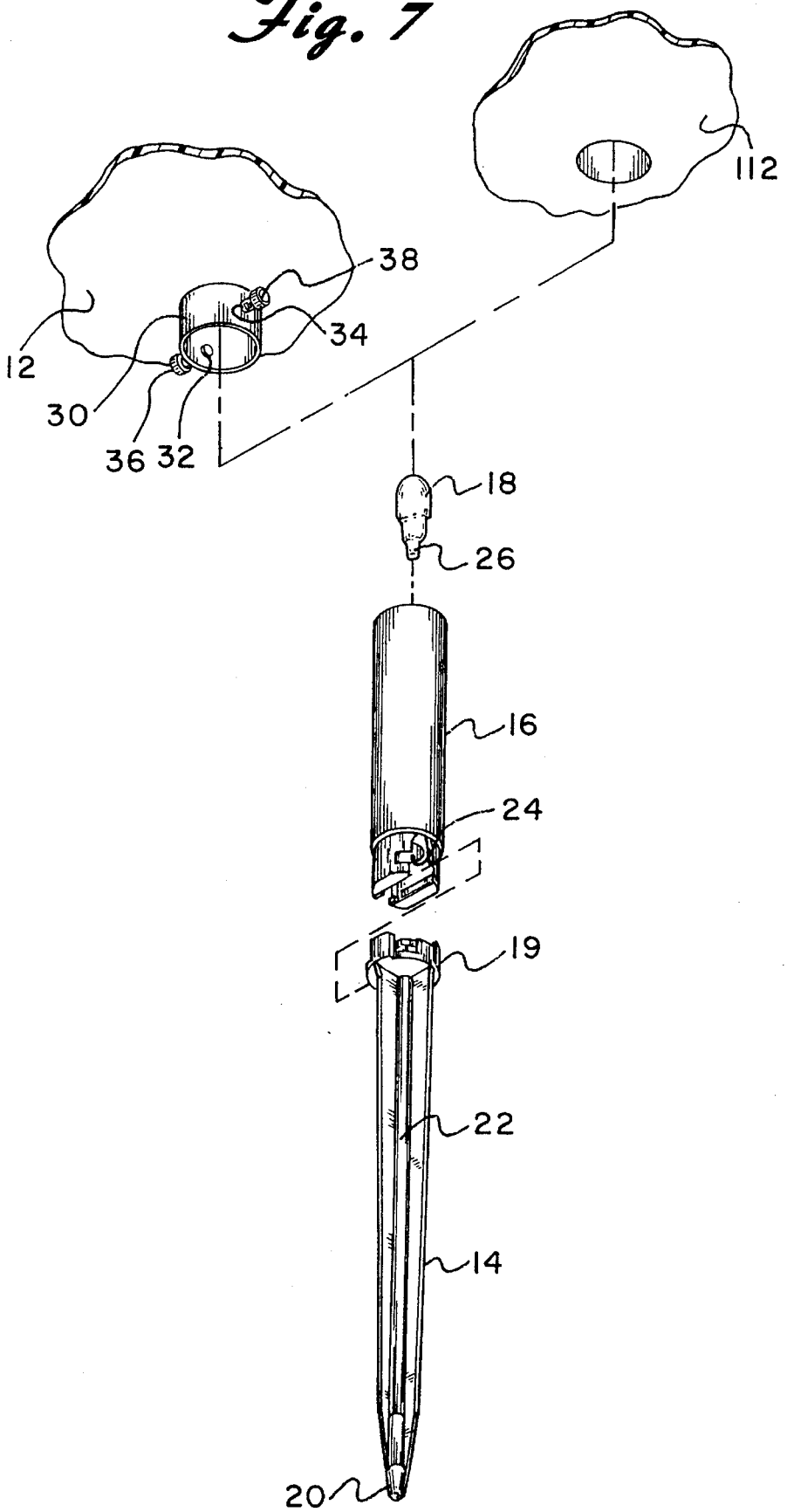
FIG. 7 is an exploded view of the light fixture showing the bottom of both light cover embodiments.

The support 16 is secured to the top end 19 of the stake 14 in a known manner. The support is cylindrically shaped and is also preferably made of plastic. An opening 24 runs through the center of the support as best seen in FIG. 7. The light bulb assembly 18 has a base 26 that extends from the bottom thereof. The base is secured in a socket located in opening 24 in the top end of the support 16. In the manner well known in the art, the power wires are preferably guided up along the channel 22 in the stake 14 and up through the opening 24 in the support 16 to the socket in order to power the light bulb assembly 18.

The adjustable light enclosure or cover 10 includes a decorative globe type housing 12. Any type of light cover that permits light to be emitted can be utilized. While the figures show a pumpkin shaped light cover, it should be understood that a variety of configurations could be used. For example, the light cover could be in the form of a Santa Claus, a snow man, a Christmas tree, a baby boy or girl, etc., depending on the occasion the user wishes to celebrate.

Figure 4:
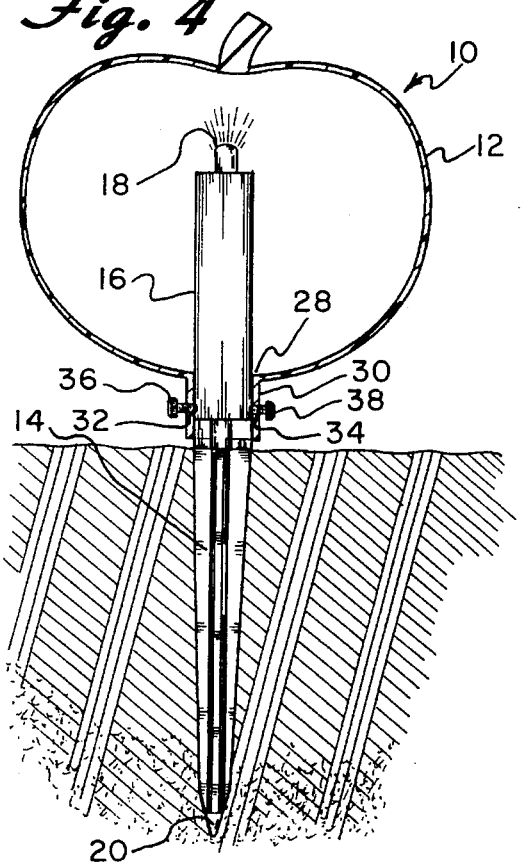
FIG. 4 is a view similar to FIG. 3 showing the light cover positioned closer to the ground.

Referring to FIGS. 1, 3 and 4, the light cover 10 has an opening 28 defined by the bottom of the same. A sleeve 30 extends downwardly from the periphery of the opening 28. The sleeve preferably has a diameter that is only slightly larger than the diameter of the support 16. Accordingly, the sleeve 30 can be slidably fit over support 16. The sleeve 30 has a pair of threaded openings 32 and 34 formed therethrough. When the sleeve 30 is fitted over the support 16, the light cover 10 surrounds the light bulb assembly 18. Since the sleeve 30 is slidable along the support 16, the distance that the housing 12 is shaped from the ground can be adjusted. For example, the housing 12 can be at a relatively large distance from the ground as shown in FIG. 3 or it can be positioned quite close to the ground as shown in FIG. 4. Obviously, the housing 12 can be located at any position in between. Accordingly, when several light fixtures are utilized in uneven terrain, the tops of adjacent covers or enclosures can be slid up or down their respective supports so that their tops will be level in order to give an orderly and aesthetically pleasing appearance.

Once the desired location of the housing is attained, the light cover is secured to the support to prevent further movement. This is accomplished by threadably securing screws 36 and 38 through a corresponding opening 32 and 34 so that the ends of the screws engage the periphery of the support 16. It should be noted that the sleeve 30 can be secured to the support 16 in other ways such as by utilizing a single thumb screw or knob or other suitable fastening means.

Figure 2:
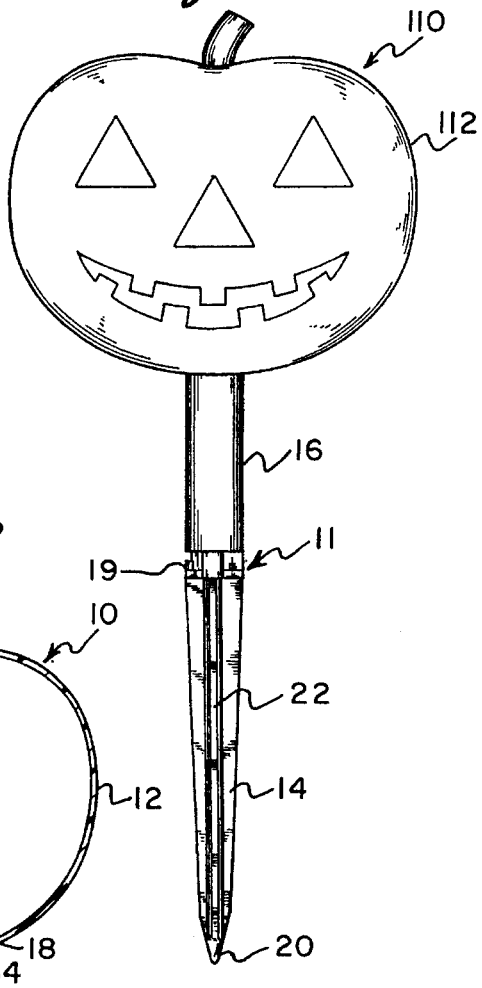
FIG. 2 is a front elevational view of an alternate embodiment that has an internally located securing means.
Figure 5:
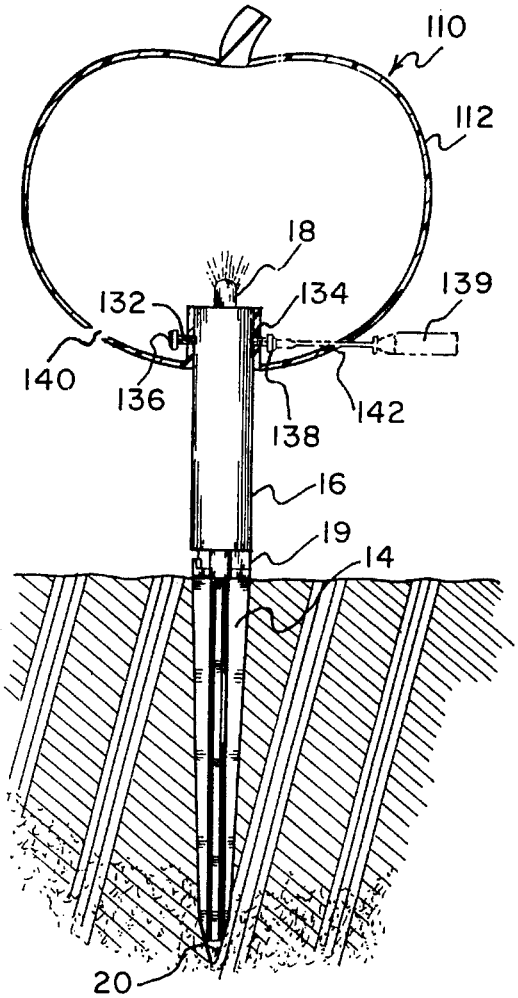
FIG. 5 is a partial cross sectional front view of the embodiment shown in FIG. 2.
Figure 6:
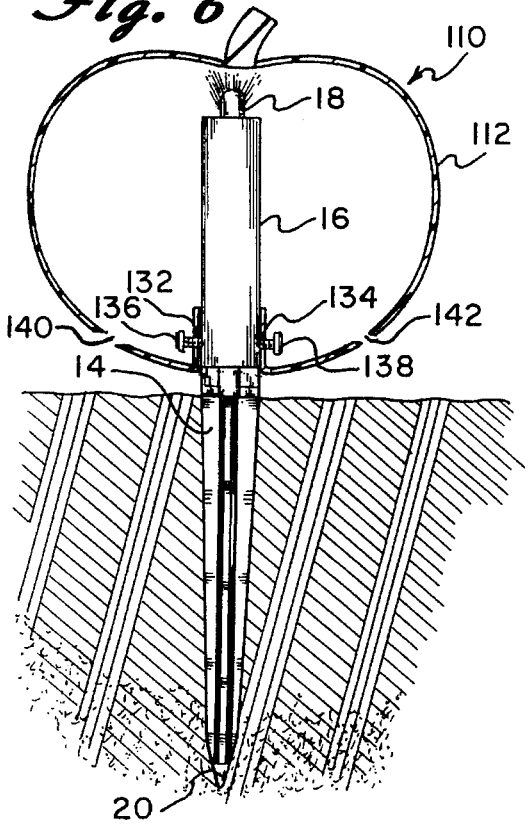
FIG. 6 is a view similar to FIG. 5 showing the light cover positioned closer to the ground.

An alternate light cover 110 is shown in FIGS. 2, 5 and 6. The light cover 110 includes a sleeve 130 that extends upwardly into the interior of a globe type housing 112 from the bottom of the same. The sleeve 130 has a pair of threaded openings 132 and 134 formed therethrough. When the sleeve 130 is fitted over the support 16, the light cover 110 surrounds the light bulb assembly 18. The light cover 110 is secured to the support by threadably securing screws 136 and 138 through openings 132 and 134 so that the ends of the screws engage the periphery of the support 16. This is accomplished by inserting a blade of a screwdriver 139 through holes 140 and 142 in housing 112 and utilizing the screwdriver to thread the screws 136 and 138 through openings 132 and 134 until the screws engage the support 16 as illustrated in FIG. 5. Since the screws are located inside of the housing 112, it is more difficult for vandals or thieves to remove the housing 112 from the support 116.

The present invention may be embodied in other specific forms without departing from the spirit or essential attributes thereof and accordingly reference should be made to the appended claims rather than to the foregoing specification as indicating the scope of the invention.

What is claimed is:

1. In a low voltage light fixture of the type that includes a support means, a light bulb assembly mounted atop said support means, a light cover positioned over said light bulb assembly and a power supply means connected through said support means to said light bulb assembly for supplying electricity to said light bulb assembly wherein the improvement comprises means for adjustably securing said light cover to said support means for adjusting the vertical position of said cover relative to said support means and said light cover being in the form of vegetation.

2. The light fixture of claim 1 wherein said securing means includes a sleeve extending downwardly from said light cover and being slidable along said support means, said sleeve including means for securing said light cover to said support means.

3. The light fixture of claim 2 wherein said securing means includes an opening formed in said sleeve and a screw adapted to be threaded through said opening for engaging said support means.

4. The light fixture of claim 1 wherein said support means includes a stake and a support extending upwardly from said stake.

5. The light fixture of claim 1 wherein said light cover is comprised of plastic.

6. In a low voltage light fixture of the type that includes a support means, a light bulb assembly mounted atop said support means, a light cover positioned over said light bulb assembly and a power supply means connected through said support means to said light bulb assembly for supplying electricity to said light bulb assembly wherein the improvement comprises means for adjustably securing said light cover to said support means for adjusting the vertical position of said cover relative to said support means and said light cover including a face shaped portion.

7. The light fixture of claim 6 wherein said securing means further includes said sleeve extending downwardly from said light cover and being slidable along said support means, said sleeve including means for securing said light cover to said support means.

8. The light fixture of claim 7 wherein said securing means includes an opening formed in said sleeve and a screw adapted to be threaded through said opening for engaging said support means.

9. The light fixture of claim 6 wherein said support means includes a stake and a support extending upwardly from said stake.

10. The light fixture of claim 6 wherein said light cover is comprised of plastic.

11. In a low voltage light fixture of the type that includes a support means, a light bulb assembly mounted atop said support means, a light cover positioned over said light bulb assembly and a power supply means connected through said support means to said light bulb assembly for supplying electricity to said light bulb assembly wherein the improvement comprises means for adjustably securing said light cover to said support means for adjusting the vertical position of said cover relative to said support means, said securing means including a sleeve extending upwardly into said light cover and being slidable along said support means, said sleeve including means for securing said light cover to said support means.

12. The light fixture of claim 11 wherein said securing means includes an opening formed in said sleeve and a screw adapted to be threaded through said opening for engaging said support means.

13. The light fixture of claim 11 wherein said support means includes a stake and a support extending upwardly from said stake.

14. The light fixture of claim 11 wherein said light cover is comprised of plastic.

15. The light fixture of claim 11 wherein said light cover the form of vegetation.

16. The light fixture of claim 11 wherein said light cover includes a face shaped portion.

* * * * *